US008215484B2

(12) United States Patent
Lim

(10) Patent No.: US 8,215,484 B2
(45) Date of Patent: Jul. 10, 2012

(54) PACKAGE MEMBER FOR FLAT PANEL DISPLAY APPARATUS

(75) Inventor: Bong Sup Lim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/026,322

(22) Filed: Feb. 14, 2011

(65) Prior Publication Data

US 2011/0220543 A1 Sep. 15, 2011

(30) Foreign Application Priority Data

Mar. 9, 2010 (KR) ..... 10-2010-0020621

(51) Int. Cl.
*B65D 85/00* (2006.01)

(52) U.S. Cl. ..... 206/320; 206/592; 206/594

(58) Field of Classification Search ..... 206/576, 206/320, 523, 586, 587, 588, 590, 591, 592, 206/594

See application file for complete search history.

(56) References Cited

U.S. PATENT DOCUMENTS

| | | | | |
|---|---|---|---|---|
| 4,759,446 | A * | 7/1988 | Dobashi et al. | 206/586 |
| 5,385,232 | A * | 1/1995 | Foos et al. | 206/320 |
| 5,398,808 | A * | 3/1995 | Chen et al. | 206/320 |
| 5,692,618 | A * | 12/1997 | Beak | 206/586 |
| 5,772,025 | A * | 6/1998 | Chen et al. | 206/320 |
| 5,904,251 | A * | 5/1999 | Ogata et al. | 206/722 |
| 6,092,651 | A * | 7/2000 | Miller | 206/305 |
| 6,622,860 | B2 * | 9/2003 | Horbal | 206/320 |
| 7,588,148 | B2 * | 9/2009 | Yang | 206/523 |
| 7,591,373 | B2 * | 9/2009 | Horiuchi | 206/576 |
| 7,757,850 | B2 * | 7/2010 | Krizan et al. | 206/320 |
| 7,866,479 | B2 * | 1/2011 | Fan | 206/588 |
| 2005/0161366 | A1 * | 7/2005 | Kobashi et al. | 206/586 |
| 2006/0113214 | A1 * | 6/2006 | Shimizu et al. | 206/576 |
| 2006/0219596 | A1 * | 10/2006 | Lin et al. | 206/592 |
| 2009/0065385 | A1 * | 3/2009 | Kakuta et al. | 206/316.1 |
| 2009/0249752 | A1 * | 10/2009 | DiMauro | 53/473 |

FOREIGN PATENT DOCUMENTS

| | | | |
|---|---|---|---|
| KR | 1999-002533 | U | 1/1999 |
| KR | 100244203 | B1 | 11/1999 |

* cited by examiner

*Primary Examiner* — Jacob K Ackun
(74) *Attorney, Agent, or Firm* — Sughrue Mion, PLLC

(57) ABSTRACT

A package member includes a first cushioning member coupled to one end of a flat panel display apparatus, and a second cushioning member coupled to the other end of the flat panel display apparatus. The package member further includes a reinforcing pad formed of a plate-shaped member and having both ends supported by the first cushioning member and the second cushioning member. The reinforcing member increases the strength of the first and second cushioning members, enabling more safe protection of the flat panel display apparatus packaged in the package member.

19 Claims, 2 Drawing Sheets

PACKAGE MEMBER FOR FLAT PANEL DISPLAY APPARATUS

CROSS-REFERENCE TO RELATED APPLICATION

This application claims priority from Korean Patent Application No. 2010-0020621, filed on Mar. 9, 2010 in the Korean Intellectual Property Office, the disclosure of which is incorporated in its entirety herein by reference.

BACKGROUND

1. Field

Exemplary embodiments relate to a package member for a flat panel display apparatus, which may protect a flat panel display apparatus packaged therein from external shock or force.

2. Description of the Related Art

Generally, a package member for a display apparatus is provided to enclose the exterior of a display apparatus, thus serving to protect the display apparatus packaged therein from force or shock transmitted from the outside.

In recent years, flat panel display apparatuses, such as Liquid Crystal Displays (LCDs), Plasma Display Panel (PDPs), etc., have been widely used because they have a wide screen and small thickness, thus exhibiting high space utility. A package member, used to package a flat panel display apparatus, for example, includes a pair of cushioning members, which are made of foam resin and are respectively coupled to upper and lower ends of the flat panel display apparatus to support the upper and lower ends of the display apparatus, and a package box configured to receive the flat panel display apparatus to which the pair of cushioning members have been coupled.

SUMMARY

Exemplary embodiments provide a package member for a flat panel display apparatus, which enables more safe storage of a flat panel display apparatus.

Additional aspects of the exemplary embodiment will be set forth in part in the description which follows and, in part, will be obvious from the description, or may be learned by practice of the exemplary embodiment.

In accordance with an aspect of the exemplary embodiment, a package member for a flat panel display apparatus includes a first cushioning member coupled to one end of the flat panel display apparatus, a second cushioning member coupled to the other end of the flat panel display apparatus, and a reinforcing pad formed of a plate-shaped member and having one end supported by the first cushioning member and the other end supported by the second cushioning member to cover a space between the first cushioning member and the second cushioning member.

The first cushioning member may include a first seating portion in which one end of the flat panel display apparatus is seated, and the second cushioning member may include a second seating portion in which the other end of the flat panel display apparatus is seated.

The flat panel display apparatus may include a display part having a flat plate shape and serving to display an image thereon, and a stand part fixed to a rear surface of the display part, and the first seating portion may include a stand seating portion indented in a central region of the first cushioning member, in which the stand part is seated, and display seating portions indented in opposite lateral regions of the first cushioning member, in which opposite lateral sides of the display part are seated.

The package member may further include at least one first supporting portion provided at the first cushioning member to support one end of the reinforcing pad, and at least one second supporting portion provided at the second cushioning member to support the other end of the reinforcing pad.

The at least one first supporting portion may include a pair of first supporting portions extending from opposite lateral rims of the first cushioning member to support an outer surface of one end of the reinforcing pad, and the at least one second supporting portion may include a pair of second supporting portions extending from opposite lateral rims of the second cushioning member to support an outer surface of the other end of the reinforcing pad.

The package member may further include a first protrusion protruding inward from the first supporting portion, a second protrusion protruding inward from the second supporting portion, and a pair of insertion recesses indented in both ends of the reinforcing pad to have a cross sectional shape corresponding to that of the first and second protrusions such that the first protrusion and the second protrusion are inserted respectively into the insertion recesses.

The first cushioning member and the second cushioning member may respectively have a rectangular cross section, and the reinforcing pad may be formed by bending a plate-shaped member to have a rectangular tubular shape.

The package member may further include a package box in which the flat panel display apparatus, to opposite sides of which the first cushioning member and the second cushioning member have been coupled, is received.

The package box may include a first package box having a first receiving space, one side of which is open to receive the first cushioning member, and a second package box having a second receiving space, one side of which is open to receive the second cushioning member, the flat panel display apparatus, and the first package box in which the first cushioning member has been received.

An aspect of another exemplary embodiment provides packaging for a flat panel display apparatus including: a first member coupled to one end of the flat panel display apparatus; a second member coupled to another end of the flat panel display apparatus; and a sleeve disposed between the first member and the second member to cover a space between the first member and the second member, wherein the first member is disposed about an outer surface of one end of the sleeve and the second member is disposed about an outer surface of another end of the sleeve.

The first member may include at least one first protrusion and the second member may include at least one second protrusion, and the one end of the sleeve may include at least one first slot which receives the first protrusion of the first member and the other end of the sleeve may include at least one second slot which receives the second protrusion of the second member.

The at least one first protrusion and the at least one second protrusion may include a plurality of enlarged distal ends, and the at least one first slot may be disposed between the enlarged distal end of the at least one first projection and an outer wall of the first member, and the at least one second slot may be disposed between the enlarged distal end of the at least one second projection and an outer wall of the second member.

BRIEF DESCRIPTION OF THE DRAWINGS

These and/or other aspects of the exemplary embodiments will become apparent and more readily appreciated from the following description of the embodiments, taken in conjunction with the accompanying drawings of which.

DETAILED DESCRIPTION

Figure 1:
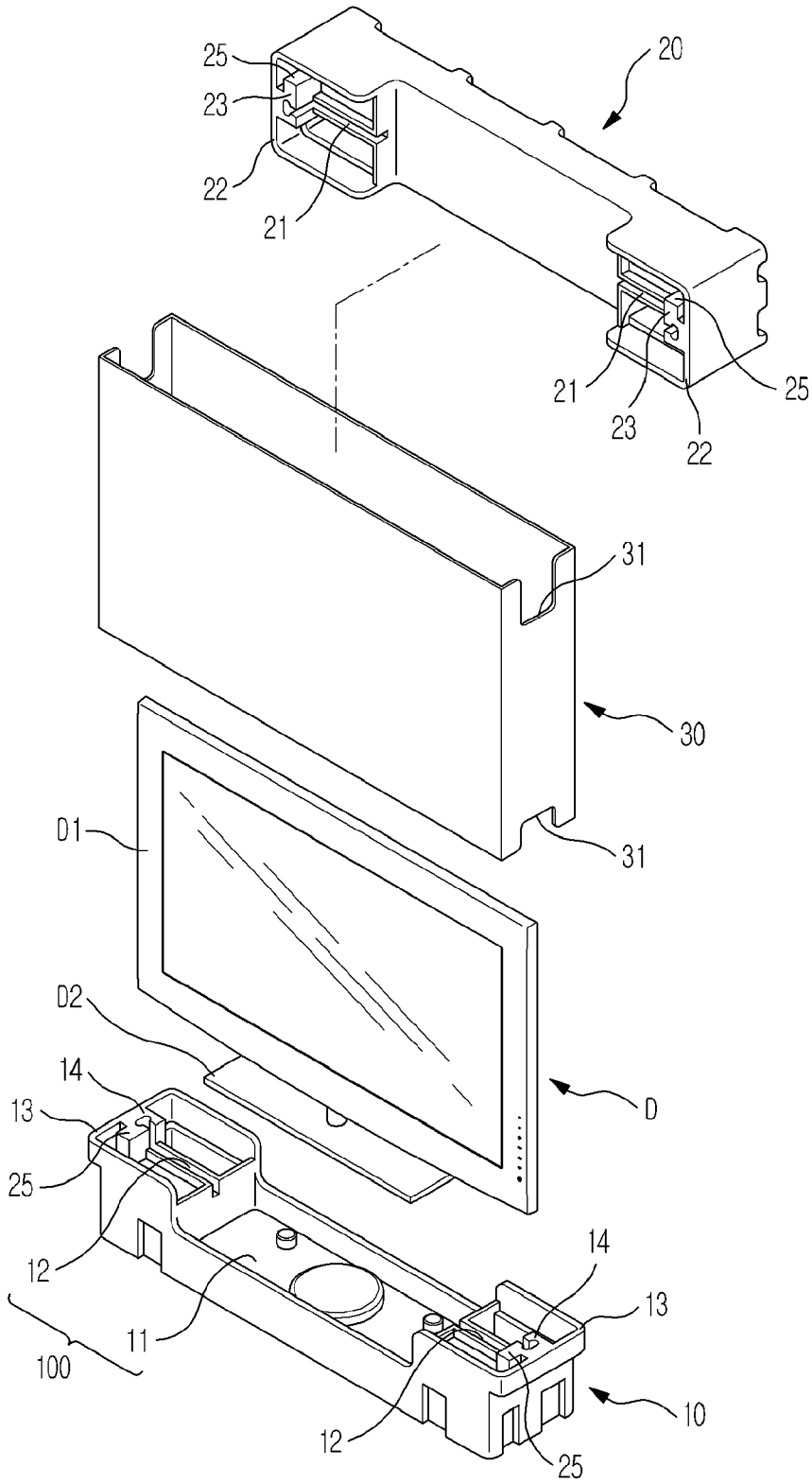
FIGS. 1 and 2 are perspective views illustrating a flat panel display apparatus packaging method using a package member for a flat panel display apparatus according to an exemplary embodiment.

Hereinafter, a package member, i.e., packaging, for a flat panel display apparatus according to an exemplary embodiment will be described in detail, examples of which are illustrated in the accompanying drawings, wherein like reference numerals refer to like elements throughout.

As illustrated in FIG. 1, the flat panel display apparatus D includes, for example, a display part D1 in the form of a flat panel, a front surface of which displays an image, and a stand part D2 coupled to a rear surface of the display part D1 so that the display apparatus D is substantially vertically erected on a horizontal plane, such as an upper surface of a table or desk. Examples of the flat panel display apparatus D may include an LCD and a PDP.

The package member for the flat panel display apparatus D includes a first cushioning member 10 coupled to a lower end of the flat panel display apparatus D to support the lower end of the display apparatus D, and a second cushioning member 20 coupled to an upper end of the flat panel display apparatus D to support the upper end of the display apparatus D.

The first cushioning member 10 and the second cushioning member 20 may be made of foam resin to protect the flat panel display apparatus D from external shock. The first cushioning member 10 has first seating portions 100 indented in an upper surface thereof, in which the lower end of the flat panel display apparatus D is seated and supported. The second cushioning member 20 has second seating portions 21 indented in a lower surface thereof, in which the upper end of the flat panel display apparatus D is seated and supported. In the present exemplary embodiment, the first seating portions 100 include a stand seating portion 11 indented, i.e., is recessed, in a central region of the first cushioning member 10 to support the stand part D2 seated therein, and a pair of display seating portions 12 indented, i.e., are recessed, in opposite lateral regions of the first cushioning member 10 to support opposite lateral sides of a lower end of the display part D1 seated therein. The second seating portions 21 are indented in opposite lateral regions of the second cushioning member 20 to support opposite lateral sides of an upper end of the display part D1 seated therein.

The flat panel display apparatus D has a significantly smaller front-to-rear thickness than a left-to-right length thereof and thus, the first and second cushioning members 10 and 20 used to package the flat panel display apparatus D may have a smaller front-to-rear thickness than a left-to-right length. In this way, the first and second cushioning members 10 and 20 may have a sufficient strength in a left-to-right direction, but may have an insufficient strength in a front-to-rear direction thereof.

Accordingly, the package member for the flat panel display apparatus D may further include a reinforcing pad 30, e.g., sleeve or box, which has one end supported by the first cushioning member 10 and the other end supported by the second cushioning member 20, thus allowing the first cushioning member 10 and the second cushioning member 20 to be supported by each other without using the flat panel display apparatus D therebetween for support. The reinforcing pad 30 may enhance the strength of the package member for the flat panel display apparatus D. Specifically, the reinforcing pad 30 may be formed of a plate-shaped member to cover a space between the first cushioning member 10 and the second cushioning member 20, thus enclosing the exterior of the flat panel display apparatus D installed between the first cushioning member 10 and the second cushioning member 20.

In the present exemplary embodiment, since the first cushioning member 10 and the second cushioning member 20 have an approximately rectangular cross section taken along a plane in the front-to-rear and left-to-right directions, the reinforcing pad 30 may be obtained by bending a plate-shaped member to have a rectangular tubular cross section such that both ends of the reinforcing pad 30 are supported respectively by rims, or edges, of the first and second cushioning members 10 and 20. The ends of the reinforcing pad 30 are supported at inner surfaces of the rims of the first and second cushioning members 10, 20.

To support both ends of the reinforcing pad 30, the first cushioning member 10 is provided at opposite lateral sides of the upper surface thereof with first supporting portions 13 to support an outer surface of a lower end of the reinforcing pad 30, and the second cushioning member 20 is provided at opposite lateral sides of the lower surface thereof with second supporting portions 22 to support an outer surface of an upper end of the reinforcing pad 30. In the present exemplary embodiment, the first supporting portions 13 and the second supporting portions 22 protrude respectively from the rims of the upper surface of the first cushioning member 10 and the lower surface of the second cushioning member 20 facing each other, such that the outer surface of the reinforcing pad 30 is supported on inner surfaces of the first and second supporting portions 13 and 22.

To stably keep both ends of the reinforcing pad 30 coupled to the first and second cushioning members 10 and 20, the first supporting portions 13 and the second supporting portions 22 respectively have inwardly protruding first protrusions 14 and second protrusions 23. The first and second protrusions 14, 23 protrude in a direction substantially perpendicular to the direction in which the first and second supporting portions 13, 22 protrude. The reinforcing pad 30 has insertion recesses 31 indented in both ends thereof, which have a cross sectional shape corresponding to that of the first and second protrusions 14 and 23 to receive the first and second protrusions 14 and 23 therein. The first and second protrusions 14, 23 each include an enlarged distal end formed by a projection 25 extending from a distal end of each of the protrusions 14, 23. The projections 25 extends in the direction perpendicular to the direction in which the first and second protrusions 14, 23 protrude and perpendicular to the direction in which the first and second supporting portions 13, 22 protrude. The insertion recesses 31 are disposed between the first and second supporting portions 13, 22 and the respective projections 25. In the present exemplary embodiment, since the first supporting portions 13 are formed at opposite lateral sides of the first cushioning member 10 and the second supporting portions 22 are formed at opposite lateral sides of the second cushioning member 20, the insertion recesses 31 are provided at opposite lateral sides, i.e., left and right sides, of the upper and lower ends, for a total of four positions on the reinforcing pad 30.

Figure 2:
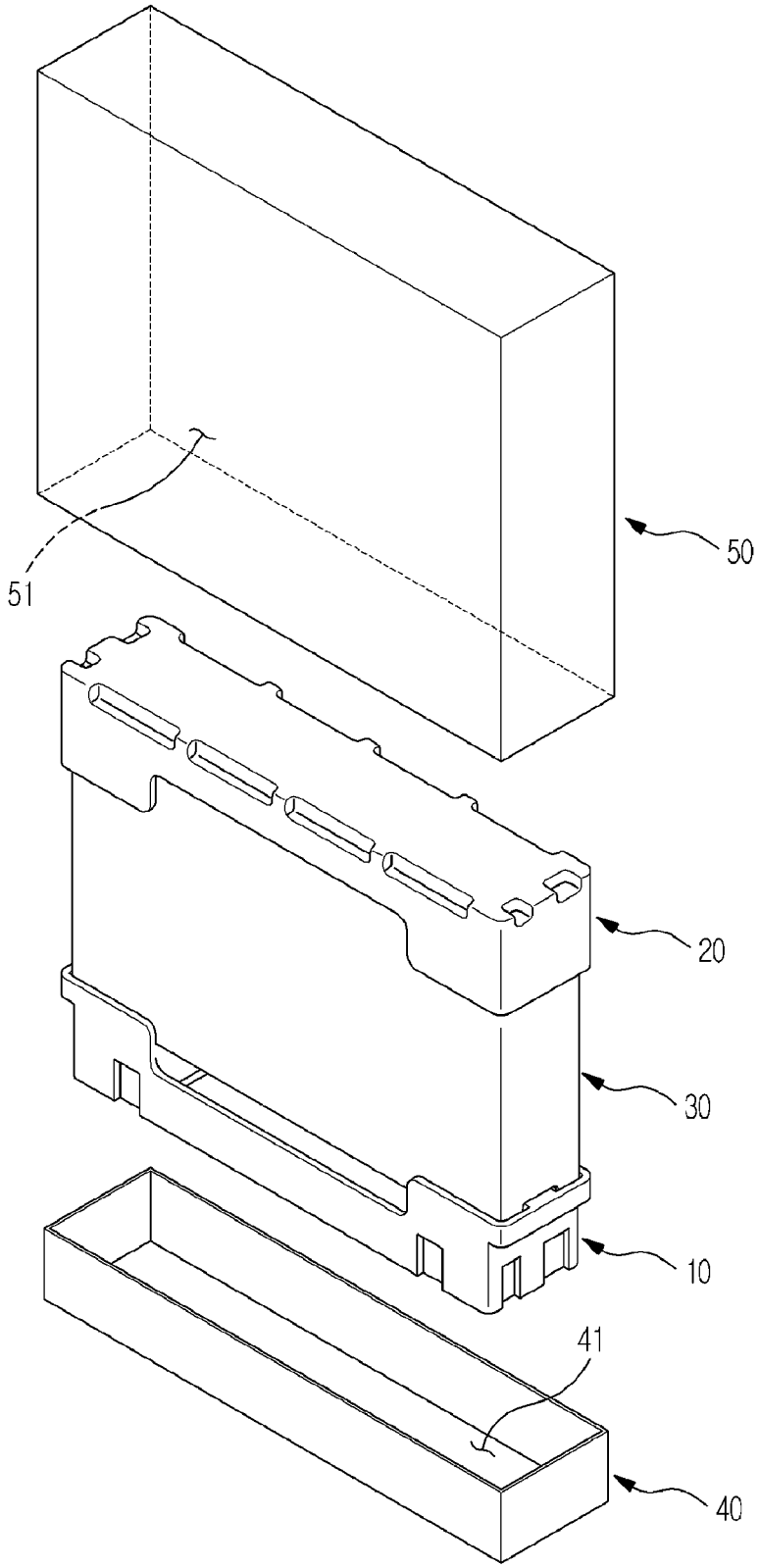

The package member for the flat panel display apparatus D, as illustrated in FIG. 2, may further include package boxes 40 and 50 provided respectively at upper and lower ends thereof, into which the flat panel display apparatus D, to which the first and second cushioning members 10 and 20 have been coupled, is packed. In the present exemplary embodiment, the package boxes 40 and 50 include a first package box 40 in which a first receiving space 41 having an open upper side is defined such that at least a part of the first cushioning member 10 is received in the first receiving space 41, and a second package box 50 in which a second receiving space 51 having an open lower side is defined such that the flat panel display apparatus D, the first cushioning member 10, the second cushioning member 20 and the first package box 40 are substantially received in the second receiving space 51.

With the above described configuration, as illustrated in FIG. 1, after the flat panel display apparatus D is seated on the first seating portions 100 of the first cushioning member 10 and then, the reinforcing pad 30 is mounted inside the first supporting portions 13 of the first cushioning member 10, the second cushioning member 20 is coupled to the upper end of the flat panel display apparatus D and the upper end of the reinforcing pad 30. In a state in which the flat panel display apparatus D and the reinforcing pad 3 are mounted between the first cushioning member 10 and the second cushioning member 20, as illustrated in FIG. 2, the first cushioning member 10 is received in the first receiving space 41 of the first package box 40 and thereafter, the second cushioning member 20, the reinforcing pad 30 and the first package box 40 are substantially received in the second receiving space 51 of the second package box 50, completing packaging of the flat panel display apparatus D.

As is apparent from the above description, in a package member for a flat panel display apparatus according to the exemplary embodiment, first and second cushioning members of the package member are supported by each other with a reinforcing pad interposed therebetween, and the reinforcing pad furthermore serves to enhance the strength of the first and second cushioning members. This may further reduce external shock or force to be transmitted to a flat panel display apparatus packaged in the package member, thereby enabling more safe protection of the flat panel display apparatus.

Although the exemplary embodiment has been shown and described, it would be appreciated by those skilled in the art that changes may be made in the exemplary embodiment without departing from the principles and spirit of the inventive concept, the scope of which is defined in the claims and their equivalents.

What is claimed is:

1. A package member for a flat panel display apparatus comprising:

a first cushioning member coupled to one end of the flat panel display apparatus;

a second cushioning member coupled to another end of the flat panel display apparatus; and a reinforcing pad having a box-shaped sleeve shape and comprising one end of the reinforcing pad supported within the first cushioning member and another end of the reinforcing pad supported within the second cushioning member to substantially enclose a space between the first cushioning member and the second cushioning member.

2. The package member according to claim 1, wherein:

the first cushioning member comprises a first seating portion in which the one end of the flat panel display apparatus is disposed; and the second cushioning member comprises a second seating portion in which the other end of the flat panel display apparatus is disposed.

3. The package member according to claim 2, wherein:

the flat panel display apparatus comprises a display part having a flat plate shape and displays an image thereon, and a stand part fixed to a surface of the display part; and the first seating portion comprises a stand seating portion comprising an indented area in a central region of the first cushioning member, in which the stand part is disposed, and a plurality of display seating portions formed in opposite lateral regions of the first cushioning member, in which opposite lateral sides of the display part are disposed.

4. The package member according to claim 1, wherein:

the first cushioning member comprises at least one first supporting portion to support the one end of the reinforcing pad; and the second cushioning member comprises at least one second supporting portion to support the other end of the reinforcing pad.

5. The package member according to claim 4, wherein:

the at least one first supporting portion comprises a pair of first supporting portions extending from a pair of opposite lateral edges of the first cushioning member to support an outer surface of the one end of the reinforcing pad; and the at least one second supporting portion comprises a pair of second supporting portions extending from a pair of opposite lateral edges of the second cushioning member to support an outer surface of the other end of the reinforcing pad.

6. The package member according to claim 4, wherein:

the first cushioning member comprises a first protrusion protruding inward from the at least one first supporting portion;

the second cushioning member comprises a second protrusion protruding inward from the at least one second supporting portion; and a pair of insertion recesses formed in both of the ends of the reinforcing pad and comprising respective cross sectional shapes corresponding to cross-sectional shapes of the first protrusion and the second protrusions and wherein the first protrusion and the second protrusion are inserted respectively into the insertion recesses.

7. The package member according to claim 1, wherein:

the first cushioning member and the second cushioning member comprise rectangular cross sections; and the reinforcing pad is formed by bending a plate-shaped member to comprise a rectangular tubular shape.

8. The package member according to claim 1, further comprising a package box in which the flat panel display apparatus is disposed.

9. The package member according to claim 8, wherein the package box comprises a first package box having a first receiving space, one side of the first receiving space being open to receive the first cushioning member, and a second package box having a second receiving space, one side of the second receiving box being open to receive the second cushioning member, the flat panel display apparatus, and the first package box in which the first cushioning member is disposed.

10. The package member according to claim 1, wherein the reinforcing pad substantially encloses the flat panel display apparatus between the first cushioning member and the second cushioning member.

11. The package member according to claim 1, wherein the reinforcing pad includes a plurality of insertion recesses formed in the reinforcing pad which correspond to shapes of protrusions of the first and second cushioning members, and wherein the first and second cushioning members are inserted respectively into the plurality of insertion recesses.

12. Packaging for a flat panel display apparatus comprising:

a first member coupled to one end of the flat panel display apparatus;

a second member coupled to another end of the flat panel display apparatus; and a boxed-shape sleeve disposed between the first member and the second member to cover a space between the first member and the second member, wherein the first member is disposed about an outer surface of one end of the sleeve and the second member is disposed about an outer surface of another end of the sleeve.

13. The packaging according to claim 12, wherein the first member comprises at least one first protrusion and the second member comprises at least one second protrusion, and wherein the one end of the sleeve comprises at least one first slot which receives the first protrusion of the first member and the other end of the sleeve comprises at least one second slot which receives the second protrusion of the second member.

14. The packaging according to claim 13, wherein the at least one first protrusion and the at least one second protrusion comprise a plurality of enlarged distal ends, and the at least one first slot is disposed between the enlarged distal end of the at least one first projection and an outer wall of the first member, and the at least one second slot is disposed between the enlarged distal end of the at least one second projection and an outer wall of the second member.

15. A package member for a flat panel display, the package member comprising:

a first cushioning member coupled to one end of the flat panel display;

a second cushioning member coupled to another end of the flat panel display; and a boxed-shape sleeve which has a first opening at a top portion of the sleeve and a second opening at a bottom portion of the sleeve, wherein the sleeve substantially encompasses a substantial portion of the flat panel display.

16. The package member according to claim 15, wherein the bottom portion of the sleeve is insertable into the first cushioning member and the top portion of the sleeve is insertable into the second cushioning member.

17. The package member according to claim 15, wherein the sleeve has a substantially rectangular cross section.

18. The package member according to claim 15, wherein the sleeve substantially covers a space between the first cushioning member and the second cushioning member.

19. The package member according to claim 15, wherein the first cushioning member includes a recessed portion operable to receive the bottom portion of the flat panel display.

* * * * *